US007513167B1

(12) United States Patent
Serata

(10) Patent No.: US 7,513,167 B1
(45) Date of Patent: Apr. 7, 2009

(54) SINGLE-FRACTURE METHOD AND APPARATUS FOR AUTOMATIC DETERMINATION OF UNDERGROUND STRESS STATE AND MATERIAL PROPERTIES

(76) Inventor: Shosei Serata, 2000 Walnut Ave., B-204, Fremont, CA (US) 94538

( * ) Notice: Subject to any disclaimer, the term of this patent is extended or adjusted under 35 U.S.C. 154(b) by 222 days.

(21) Appl. No.: 11/595,175

(22) Filed: Nov. 9, 2006

Related U.S. Application Data

(60) Provisional application No. 60/814,443, filed on Jun. 16, 2006.

(51) Int. Cl.
*G01N 3/08* (2006.01)

(52) U.S. Cl. ..... 73/820

(58) Field of Classification Search ..... 73/820
See application file for complete search history.

(56) References Cited

U.S. PATENT DOCUMENTS 3,961,524 A * 6/1976 de la Cruz ..... 73/783
4,461,171 A * 7/1984 de la Cruz ..... 73/152.59
4,733,567 A * 3/1988 Serata ..... 73/784
5,153,514 A * 10/1992 Griffin et al. ..... 324/303
5,576,485 A * 11/1996 Serata ..... 73/152.17

* cited by examiner

*Primary Examiner*—Harshad Patel
*Assistant Examiner*—Octavia Davis
(74) *Attorney, Agent, or Firm*—Howard Cohen

(57) ABSTRACT

An improved single-fracture method and apparatus for determining the ambient stress state and material properties of underground media includes, in one aspect, an expandable probe having high-strength steel shells with longitudinally extending, tooth-like ridges to create a maximum friction engagement with the borehole boundary. The single fracture method establishes a force-balance between the probe expansion pressure and the underground stress vector acting perpendicular to the single fracture plane, whereby the expansion pressure and stress vector are related by a proportionality constant (n).

28 Claims, 10 Drawing Sheets

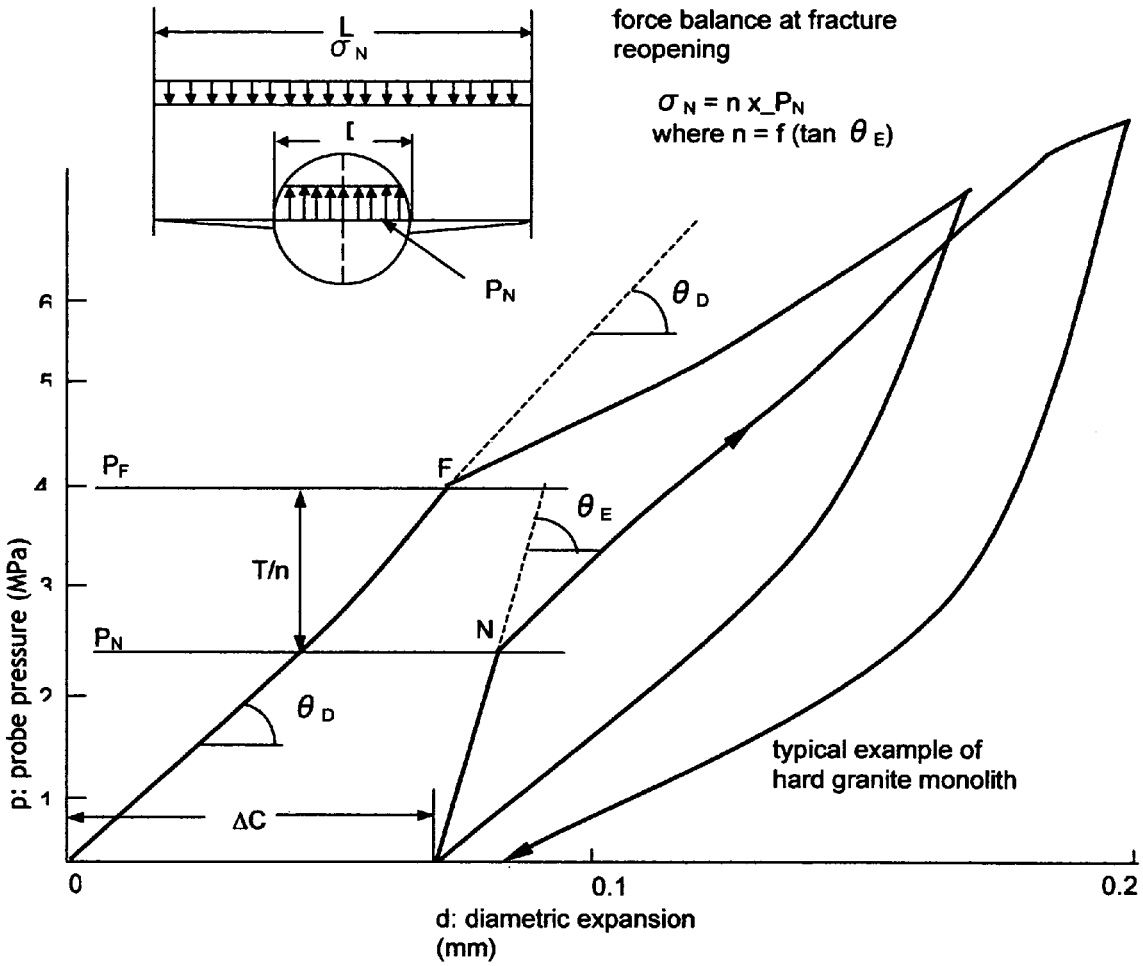

$E_E$ = elastic modulus
= $D(1 + \nu) \tan \theta_E$
$E_D$ = deformation modulus
= $D(1 + \nu) \tan \theta_D$
$\Delta C$ = ground consolidation
T = tensile strength
= $n(p_F - p_N)$ where
D = borehole I.D.
L = span of reopened fracture
$\tan \theta_E$ = elastic rigidity
$p_F$ = fracture initiation pressure
$p_N$ = fracture reopening pressure
$\sigma_N$ = ground stress normal to fracture

FIG. 8

SINGLE-FRACTURE METHOD AND APPARATUS FOR AUTOMATIC DETERMINATION OF UNDERGROUND STRESS STATE AND MATERIAL PROPERTIES

CROSS-REFERENCE TO RELATED APPLICATIONS

This application claims the benefit of the priority filing date of Provisional Application Ser. No. 60/814,443, filed Jun. 16, 2006.

FEDERALLY SPONSORED RESEARCH

Not applicable.

SEQUENCE LISTING, ETC ON CD

Not applicable.

BACKGROUND OF THE INVENTION

1. Field of the Invention

This invention relates to a method and apparatus for determining the underground stress state and material properties and, more particularly, to determining these values without dependence upon the unrealistic assumption that the underground media is an ideally elastic and homogeneous medium. This new method and apparatus may be designed to repeat the measurement automatically at a same site as needed as a function of time and aging of the ground.

2. Description of Related Art

U.S. Pat. No. 5,576,485 documents the original introduction of the Single Fracture Method for measuring both the stress state and the material properties in underground media. This groundbreaking invention is based on using an expandable borehole probe to fracture the borehole wall along a single predetermined plane that extends through the borehole axis. The probe is expanded by high pressure hydraulic fluid and the diametrical expansion is monitored by high accuracy sensors. A stable force balance that is established between the ambient ground stress vector normal to the defined fracture plane and the pressure that initiates and reopens the single-fracture plane reveals the tensile strength of the underground media, as well as the magnitude of the ambient stress that is normal to the fracture plane. By utilizing a multiple number of stress vectors obtained at a position, stress field tensor can be automatically calculated by the data analysis software installed within the stressmeter. The tensor is given in terms of maximum stress, minimum stress and their angular orientation.

The original single-fracture method was based on the assumption of an ideally elastic and homogeneous condition of underground rock media. This theoretical assumption caused a significant amount of error because of the fact that the natural rock media are found to be highly inhomogeneous with different elastic coefficient value found in different orientations. This inhomogeneity problem has been well demonstrated by irregularity of all the conventional methods of stress measurement, which are based on the assumption of ideally homogeneous elastic ground. This fundamental problem has been resolved by the advanced single-fracture method developed for general inhomogeneous ground based on the force balance principle of the present invention.

Extended experience with practical applications of the single-fracture method revealed some aspects that require improvement. For example, the loading surface of the probe did not achieve the required maximum saturated frictional engagement with the borehole wall to create an accurate single fracture reopening along the predefined plane. The lack of the required friction force diminishes the accuracy and usefulness of the method.

It was also observed that the end seal structures of the introductory designs were subject to failure in rough ground, in which features such as voids or pre-existing fractures would allow the end seal to expand excessively and fail. The original methodology did not recognize this important requirement.

The most important improvement made by the advanced method of the present invention is its expansion of the areas of application to include complex ground including elastic, non-elastic and inhomogeneous grounds successfully. It overcomes the basic difficulty of the original method, which is limited only to an ideally elastic condition. Ideally elastic and homogeneous ground is not common in ordinary ground.

BRIEF SUMMARY OF THE INVENTION

The present invention generally comprises an improved single-fracture method and apparatus for determining the ambient stress state and material properties of underground media. In one aspect, the invention introduces a new principle to the original concept: a borehole probe in which maximum saturated friction loading applied all around the boundary of the borehole wall creates a single-fracture that is accurately formed at the predefined datum plane. This approach is proven to measure both stress state and material properties by achieving a balance of force between the expanding borehole loading pressure and the force vector acting normal to the fracture.

The borehole probe constructed in accordance with the present invention generally includes a mandrel extending along an instrument axis, and a pair of end cap assemblies secured to the mandrel in axially spaced, confronting relationship. A pair of end seal assemblies are secured to respective end cap assemblies, and an expandable urethane tube loading section spans the distance between the end seal assemblies. A pair of hemi-cylindrical outer shells extend about the loading section, and are adapted to be driven into a borehole wall by expansion of the urethane loading tube.

A plurality of sensors, such as LVDT detectors, extend diametrically between the opposed shell halves of the outer shell to measure diametrical expansion of the borehole wall as a function of hydraulic inflation pressure applied to the loading section. An assembly of the Probe is connected to an operating rod to guide the probe within a borehole. A communications cable extends to the electronics module, and a hydraulic supply hose is connected in flow communications with the loading section to selectively and reiteratively inflate and retract the loading section.

One aspect of the invention is the design of the friction shells, which achieve maximum saturation friction loading against the borehole boundary to create a single-fracture in the datum plane that extends through the junction lines of the opposed edges of the semi-cylindrical shells. The maximum friction shells are formed of high-strength steel strong enough to create saturation friction all around the borehole boundary with the flexibility necessary to deform readily with the expanding boundary, thereby forming the single-fracture most accurately at the datum plane. A fiber reinforcement layer of Kevlar™ or similar high strength fiber underlays the friction shells to strengthen the friction shells to create the maximum saturated friction force to generate the single-fracture plane. In addition, a pair of blocking bars is secured in the probe and extends longitudinally along the datum plane to prevent the expandable urethane probe from leaking into the fracture plane.

A salient feature of the maximum saturation friction shells is an outer surface treatment consisting of sharp ridges extending longitudinally and spaced equally about the semi-cylindrical surface. The sharp ridges are formed of longitudinally extending facets converging at a defined angle, such as 70° or 90° to create a tapered teeth arrangement which impinges on the borehole wall to provide a maximum saturated frictional force engagement therewith.

Another aspect of the invention comprises the improved design of the end cap assemblies secured to opposed ends of the mandrel. Each end cap assembly includes an end cap secured fixedly to the mandrel, each end cap having a cup-like recess formed in the end thereof that is disposed in confronting relationship with the other end cap. The loading tube has opposed, tapered end portions dimensioned to be received cup-shaped end caps. A plurality of linking rods are disposed parallel to the instrument axis and arrayed in closely packed fashion, the rods having like ends disposed within the cup-shaped end cap and free to expand outwardly in umbrella-like fashion. Thus the other end of each linking rod is free to pivot outwardly when the loading tube expands. The end seal assembly further includes a plurality of anchor rods embedded in the elastomer and extending parallel to the instrument apparatus. The anchor rods are equal in number to the linking rods, and are arrayed like their counterparts in closely packed, angularly spaced fashion within the circumference of the assembly. Each anchor rod includes one end that engages a respective end of the adjacent linking rod in pivoting fashion. In the quiescent condition each linking rod impinges on the circumferentially adjacent linking rods. Once the anchor rod expands outwardly and establishes contact with the borehole wall, the anchor rod prevents further rotation of its paired linking rod, thereby precluding a failure mode in which a linking rod hyper-rotates and allows the loading tube to extrude or puncture.

A further aspect of the invention is an improvement in the theoretical approach to determining the ambient underground stress state and material properties in complex ground. The borehole probe described above is introduced in a borehole and expanded by increasing pressure. The p/d (pressure versus diameter expansion) curve begins at the origin when the loading tube starts pressing the borehole boundary and increases fairly linearly as the probe expansion is opposed by the combined effect of the strength of the underground media as well as the ambient underground stress vector acting in a direction normal to the single-fracture datum plane. At a point where a total value of the vector and the tensile strength of the media is exceeded, a fracture is initiated along the datum plane by the expanding probe. Further pressure increases cause a greater rate of expansion, due to the fact that only the ambient normal stress vector is resisting further opening of the fracture. When the probe pressure is reduced, the p/d curve drops down as the diameter diminishes, but it does not return to the origin. Rather, the expanding probe consolidates the borehole boundary and the quiescent state is a larger diameter.

The probe is then inflated again, rising linearly to point N, where the single-fracture begins to re-open. The probe pressure $p_N$ that initiates single fracture re-opening is a significant data point, since there is a constant relationship between the ground stress vector $\sigma_N$ acting normal to the single-fracture plane, and the probe loading pressure $p_N$ at the instant of fracture re-opening. The relationship is expressed as:

$$\sigma_N = n \cdot p_N \tag{1}$$

where:

$\sigma_N$=ground stress acting normal to single-fracture to be measured.

$p_N$=probe loading pressure at the moment of fracture reopening.

n=proportionality constant, which is a function of the stiffness of the ground; f (tan $\theta_E$).

tan $\theta_E$=elastic rigidity automatically measured by the probe.

Furthermore, the difference between the single-fracture initiating pressure $p_F$ and the reopening pressure $p_N$ reveals the tensile strength of the underground media in the direction normal to the single-fracture plane. Furthermore, the elastic modulus $E_E$ and the deformation modulus $E_D$ can be calculated easily. Thus significant material properties data may be resolved using the probe and the single fracture technique based on the improved n-function technique.

It should be emphasized that the various aspects of the invention act cooperatively and synergistically to produce a significant improvement over the prior art. That is, the probe design with the flexible maximum saturated friction shells and the reinforced end cap assemblies makes possible the accurate formation and reopening of a single fracture at the datum plane, and the consistent ability to form and reopen the single-fracture enables the use of the n-function technique to resolve the impasse of stress measurement in non-elastic complex ground.

Stress measurements acquired by the probe can be repeated at the rate up to 50 times per day at the same site to monitor stress change as a function of time. For repeated measurements over a long period, the borehole boundary can be protected by simply grouting the borehole wall as needed. Borehole grouting is a standard industry practice for securing a borehole boundary. It has been discovered that grouting the portion of the borehole wall prior to engaging it by the probe significantly extends the MTBF of that site in the borehole, without affecting the measurements and calculations described above. Grouting to protect the borehole boundary is effective only with the stress detection method of this invention.

The flexibility and ease of use of the single-fracture probe of the present invention also makes possible an embodiment that is portable and capable of monitoring a number of different borehole sites within a short span of time. The probe assembly may be suspended from a wireline cable that provides electrical power, instrument data connections, and tensile support for the probe assembly. The driving unit of the probe includes an electrical pump supplied by an oil tank to selectively inflate the loading tube. It also includes an electrical motor and gear drive to rotate the probe's electronic unit and loading unit to any selected angle about the borehole axis. Thus multiple single-fracture planes may be tested in fairly rapid reiterations of the single fracture technique at selected angles in the same location in the borehole.

The wireline is payed out from a hoist that may be transported as a trailer towed by a vehicle that also houses the system computer and junction box for the data and power signals that are connected through the wireline to the electronic unit of the probe. The technique of the invention may be carried out and values read out in real time, an advantage that is not possible with other prior art stress and property measuring systems. The remote operation probe with wireline suspension eliminates long lengths of hydraulic hoses, which would otherwise add a substantial volume that must be filled and pumped with very high pressure hydraulic fluid. The innate flexibility and expansion of the long hose makes it difficult to achieve very high pressure in the probe very quickly. The onboard pump and inflation system reduces the volume of high pressure oil to a minimum, and simplifies installation and removal in the borehole. This portable arrangement makes possible the stress monitoring of many sites, creating an efficient use of equipment and manpower.

The present invention may also find utility in carrying out the method of U.S. Pat. No. 5,675,088, issued to the present inventor, which describes a method for automatic monitoring of tectonic stresses and quantitative forecast of shallow earthquakes. This prior patent describes the fundamental processes occurring in a shallow earthquake, which is typically the most destructive to human life and property. It identifies a depth window of observation in which lateral tectonic shear stress reaches a site specific constant value in dependence of depth. This is the window for earthquake shear stress, which is measured in the range of 500~1000 meters deep, just below the earth lateral shear stress saturation depth and surface damages media, and above the inversion depth at which the vertical stress of the overburden begins to increase the lateral stress vectors. This prior patent emphasizes the fact there are changes in the underground stress field within the observation window that may be detected and used to predict an imminent earthquake.

BRIEF DESCRIPTION OF THE DRAWING

FIG. 8 is a graph depicting the expandable probe pressure vs. diameter expansion of a borehole, showing repeated cycling of the single fracture method.

DETAILED DESCRIPTION OF THE INVENTION

Figure 1:
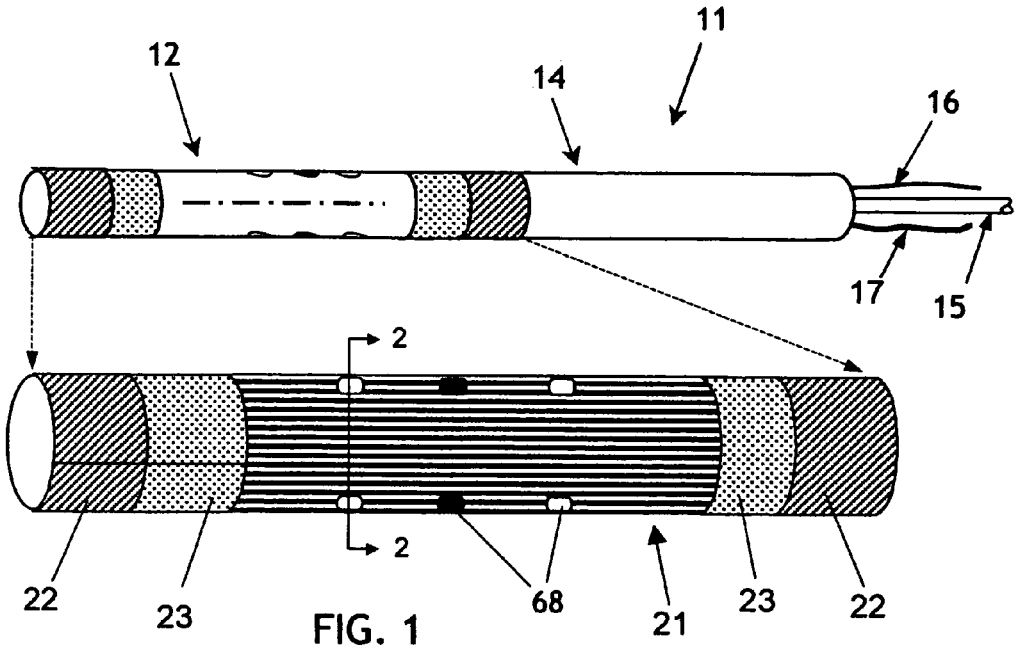
FIG. 1 is an expanded plan view of the borehole probe of the present invention.

The present invention generally comprises an improved single-fracture method and apparatus for determining the ambient stress state and material properties of underground media by an automatic means. With regard to FIGS. 1 and 2, the apparatus of the invention consists primarily of a borehole probe 11 having an elongated cylindrical configuration appropriately dimensioned to be removably received within a borehole of any standard diameter. The probe 11 includes a loading section 12 that is expandable against the borehole wall, and an axially adjacent electronic section 14 that houses the instrumentation and electronics assemblies that acquire, process, store, and transmit the data gathered by the probe. A structural rod 15, electronic cable 16 and hydraulic hose 17 extend from the section 14 to the opening of the borehole to support the instrument, transmit the data to a data processing system, described below, and provide pressurized fluid to expand the probe.

The loading section 12 includes a medial inflatable assembly 21 concentrically disposed about an axially extending mandrel 13, with an end cap 22 and end seal 23 secured to each end of the assembly 21. With regard to FIGS. 3-6, each end cap 23 includes a cup-like recess 24 to receive the end of a cylindrical loading tube 26. The loading tube 26 extends coaxially and concentrically about the mandrel 13, and includes opposed, tapered end portions 27. The loading tube is formed of soft elastomeric material, and serves as a fluid containment vessel within the pressure containment formed by the end seals and the borehole wall. The outer extent of each end portion 27 is dimensioned to be received within the annular space defined by the recess 24 and the mandrel 13. An annular seal 28 prevents leakage of the high-pressure oil.

Figure 5A:
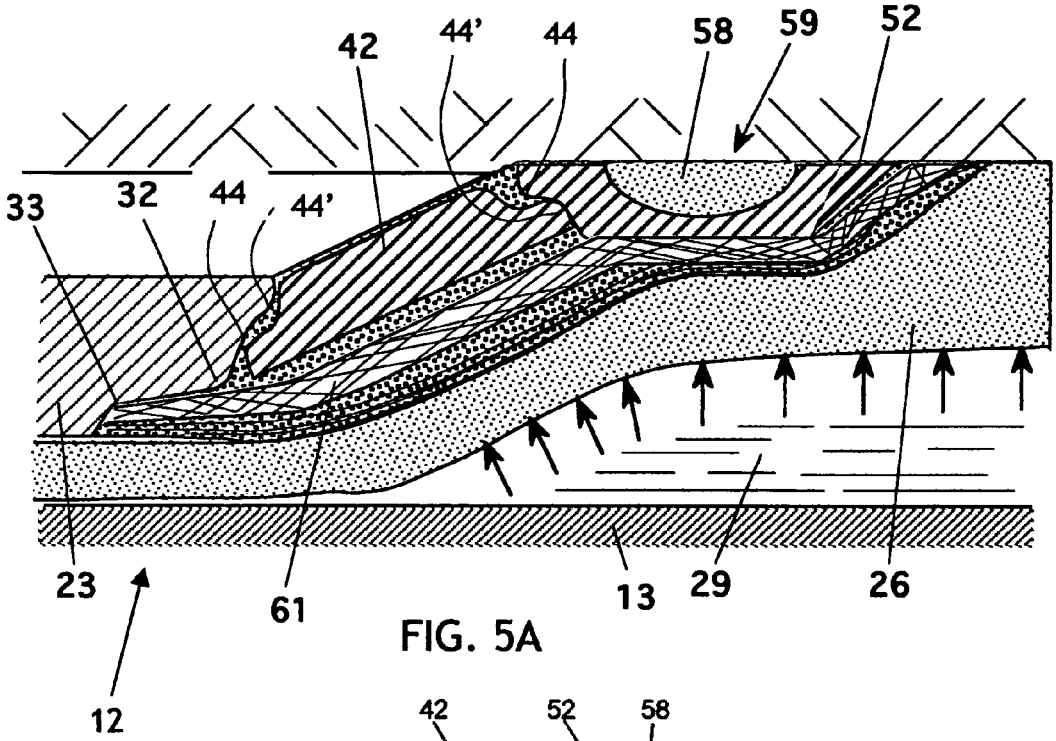
FIG. 5A is an enlarged cross-sectional detail view of the anchor rod and linking rod assembly of the end cap assembly.
Figure 5B:
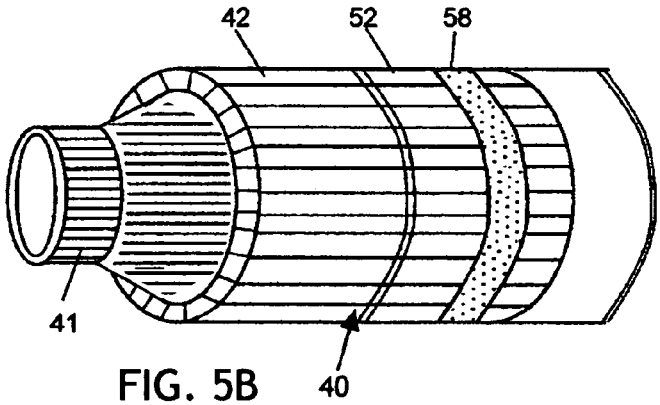
FIG. 5B is a perspective end view of the end cap assembly.
Figure 6:
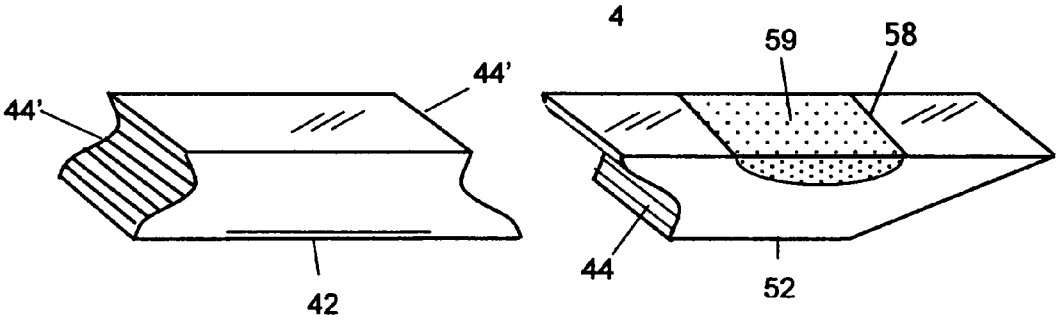
FIG. 6 is a perspective view of an anchor rod and respective linking rod, showing their mating end-to-end engagement.

The recess 24 of the end cap 23 includes an annular rim 32, as shown in FIG. 5. This rim is comprised of an inner annular chamber 33 and a specially shaped connection edge 44 formed of a convex/concave annular surface configured to engage a corresponding counterpart, as explained below. Each end seal includes an annular elastomeric assembly 40 mounted about the tapered end portion 27 of the loading tube 26 on both side of the tube. The elastomeric assembly is formed of a hard elastomeric material formed in a tubular conformation, with components cast or otherwise embedded therein. Extending from the assembly 40 is neck 41 that is received fixedly in the annular space 33 of the end cap.

Figure 4:
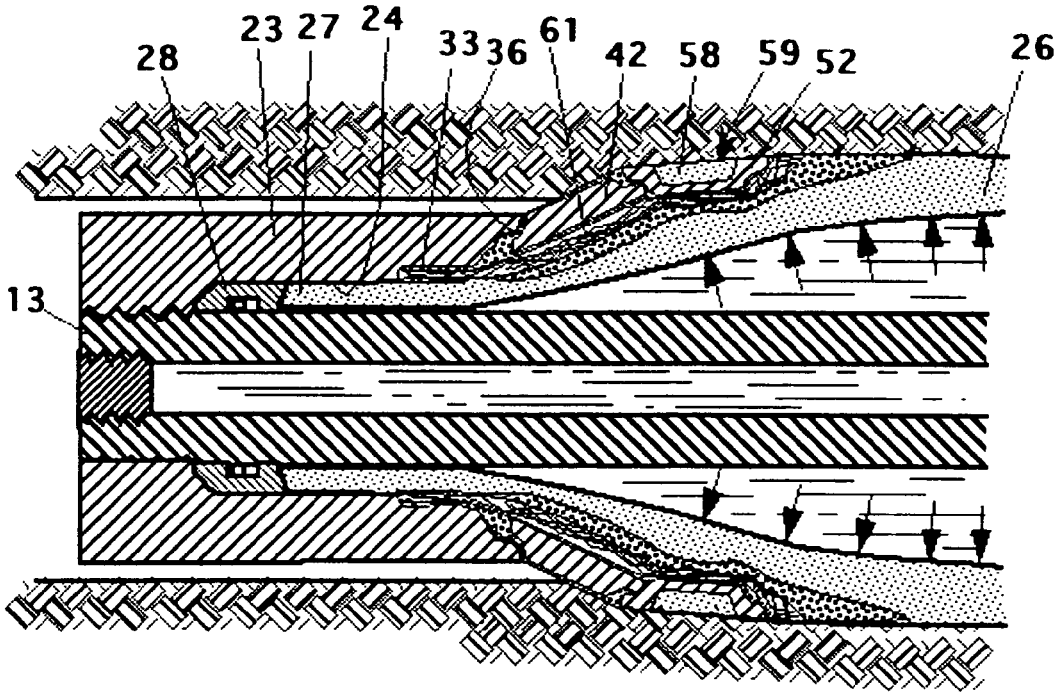
FIG. 4 is an enlarged cross-sectional elevation of the end cap and end seal assembly as in FIG. 3, shown in the expanded disposition.

As shown in FIGS. 3-6, embedded in the elastomeric assembly 40 adjacent to the neck 41 is a plurality of linking rods 42. The linking rods 42 are disposed parallel to the instrument axis and disposed in a circumferential array in closely packed fashion within the circumference of the assembly 40. In the quiescent condition each linking rod 42 impinges on the circumferentially adjacent linking rods. With regard to FIG. 6, each linking rod 42 is comprised of a generally square rod body having opposed hinge ends. Each hinge end is formed in a convex/concave shape 44' that is a complementary fit with the connection edge 44. More specifically, the hinge ends of like outer ends of the rods 42 are engaged with the edge 44 of the end cap 23, so that the rods 42 may rotate outwardly to a limited extent from their paraxial alignment, as shown in FIGS. 4 and 5.

The elastomeric assembly 40 further includes a plurality of anchor rods 52 embedded in the elastomer and extending parallel to the instrument apparatus. The anchor rods are equal in number to the linking rods, and are arrayed like their counterparts in closely packed, angularly spaced fashion within the circumference of the assembly 40. In the quiescent condition each anchor rod impinges on the circumferentially adjacent rods. With regard to FIGS. 5-9, each anchor rod 52 is comprised of a generally rectangular body having a hinge end 44 only at one end. The hinge end 44 is formed in like complementary fashion to the linking rod counterparts 44. The hinge end 44 of each anchor rod 52 engages the inner end of a respective linking rod 42 in a hinged pair relationship, so that each paired anchor rod and linking rod may expand radially outwardly while maintaining engagement, as shown in FIGS. 4 and 5A.

Each anchor rod 52 further includes an arcuate channel 58 extending through a medial portion thereof, the axis of the channel 58 disposed generally transverse to the longitudinal axis of the body 12 as shown in FIG. 5-A. The anchor rod end 44' is disposed radially outwardly of the respectively engaged linking rod end, thereby limiting the outward rotation of the linking rod about the edge 44 by requiring the end of each linking rod to displace the engaged anchor rod radially outwardly. Once the anchor rod establishes contact with the borehole wall (FIG. 5A), the anchor rod provides a solid base to support the linking rod even in weak complex borehole boundary.

The parallel alignment of the anchor rods 52 determines that the arcuate channels 58 of the rods 52 are aligned to define an annular groove extending about the elastomeric assembly 40. A circumferential band 59 of elastomeric material is embedded in the assembly 12 and disposed to fill the arcuate channels 58 of all the rods 52. The elastomer material 59 has a high coefficient of elasticity and a low hysteresis factor, whereby the band 59 exerts a powerful restoring force uniformly on all the anchor rods. The band 59 acts to retract the anchor rods radially inwardly after expansion of the loading tube and the engagements of the ends 44 cause the anchor rods 52 to rotate the linking rods radially inwardly, thus assuring that the expanded end seal assembly will retract properly and release the engagement with the borehole wall.

Each linking rod 42 is engaged at one end to the end cap. Due to the fact that the one end of the linking rod is hinged to the end cap, the one end is prevented from moving radially outwardly. However, the opposed end of each linking rod is free to pivot outwardly when the loading tube expands, and the complementary engagements of the linking rods with the end cap facilitate a hinged engagement that permit limited outward rotation of each linking rod, as shown in FIG. 5A. The linking rods 42 provide an expandable, umbrella-like structure that supports and contains the portion of the loading tube extending between the end cap 23 and the borehole wall.

Without some additional measure, the end seal thus described cannot withstand high-liquid pressure build-up in the loading tube because an open space is created between individual rods in the circumferential direction as the probe expands. This problem is solved by development of an inner seal, which is a cylindrical structure made of layers of high-strength fibers 61 shown in FIG. 5A. The fibers 61 are arranged in a diagonal (helical) orientation so that the fibers can expand to a limited extent to form a fiber bridge spanning the gap between the rods 52 as well as the gap between the rods 42 to achieve the high-pressure sealing. Thus the loading tube is prevented from extruding outwardly between the linking rods and anchor rods.

Figure 2:
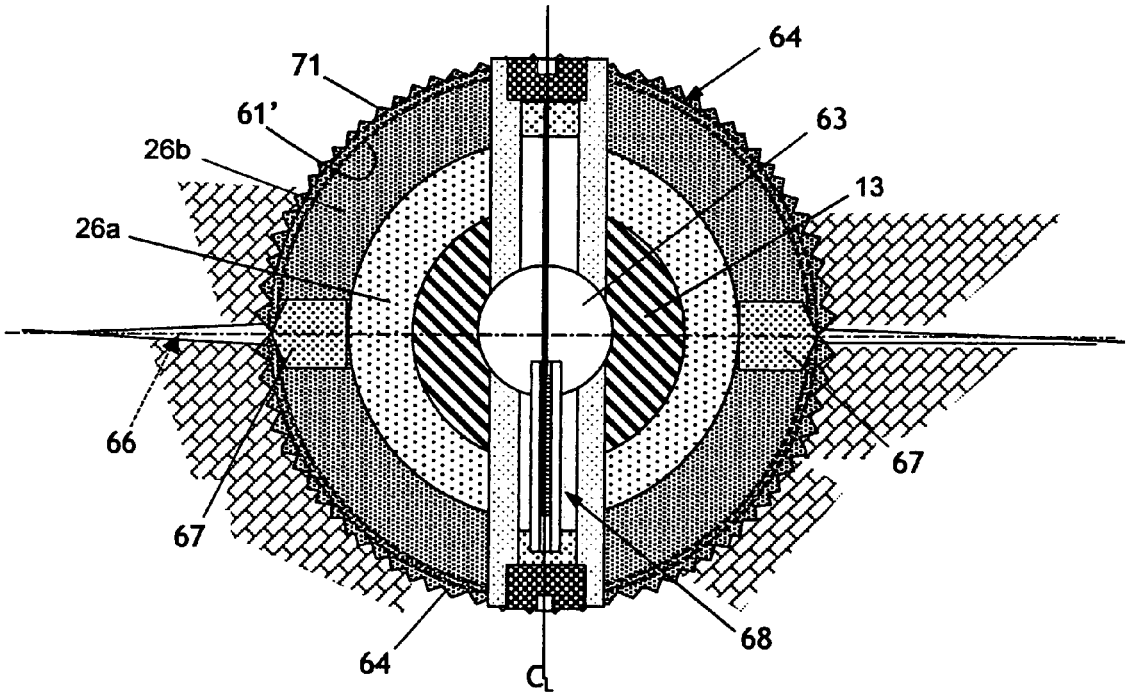
FIG. 2 is a cross-sectional elevation of the loading section, taken along line 2-2 of FIG. 1.
Figure 3:
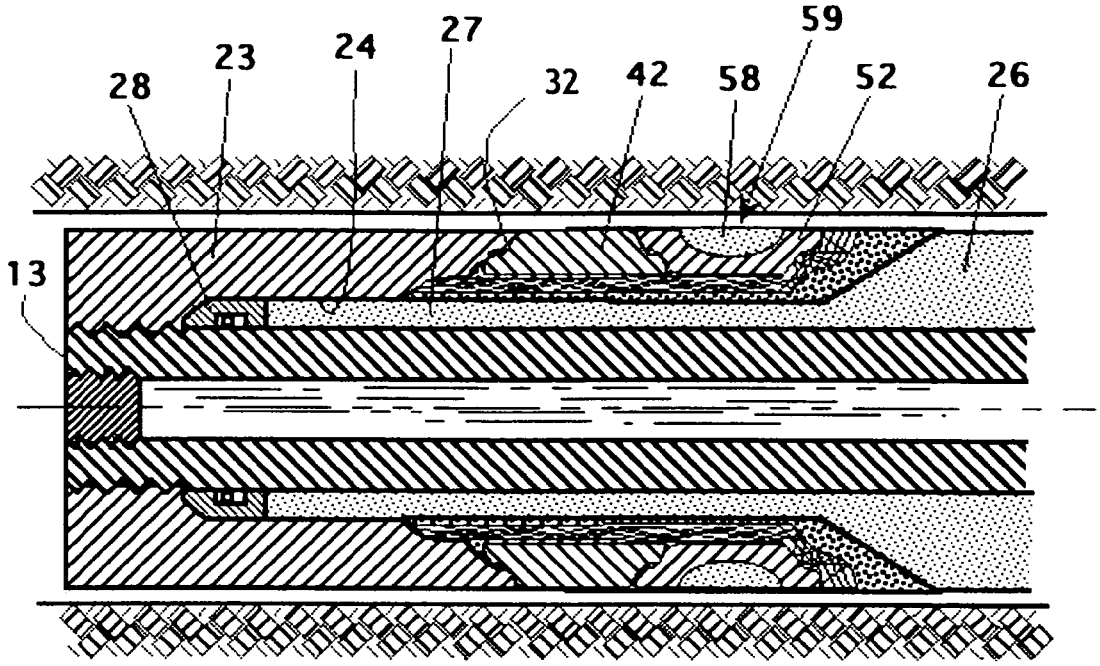
FIG. 3 is an enlarged cross-sectional elevation of the end cap and end seal assembly of the borehole probe of the present invention, shown in the unexpanded disposition.

With regard to FIG. 2, the loading tube 26 may be comprised of an inner urethane sleeve 26*a* and an outer urethane sleeve 26*b*, both disposed concentrically about the mandrel 13. The mandrel 13 includes an axially extending passage 63 that supplies high pressure hydraulic fluid to the space between the inner sleeve 26*a* and the mandrel 13 to inflate the loading tube 26 and drive it radially outwardly toward the borehole wall. With additional reference to FIG. 7, a significant aspect of the probe is the provision of a pair of hemi-cylindrical outer shells 64 secured to the outer surface of the outer urethane sleeve 26*b*. The opposed edges of the pair of shells 64 are disposed in a datum plane 66, and the shells may be displaced generally perpendicularly to the datum plane 66 when the loading tube 26 is inflated by hydraulic pressure. A pair of blocking bars 67 are embedded in the outer urethane sleeve 26*b* and extend longitudinally along the datum plane to obstruct the opening formed between the shells 64 and prevent the urethane sleeve 26*b* from being extruded outwardly between the shells 64. At least one, and preferably a plurality of LDVT transducers 68 are secured in the probe loading section 21, extending diametrically through the assembly of the mandrel, loading tube and secured to the friction shells 64, whereby the displacement of the friction shells perpendicular to the datum plane 66 may be measured with great accuracy.

Figure 7:
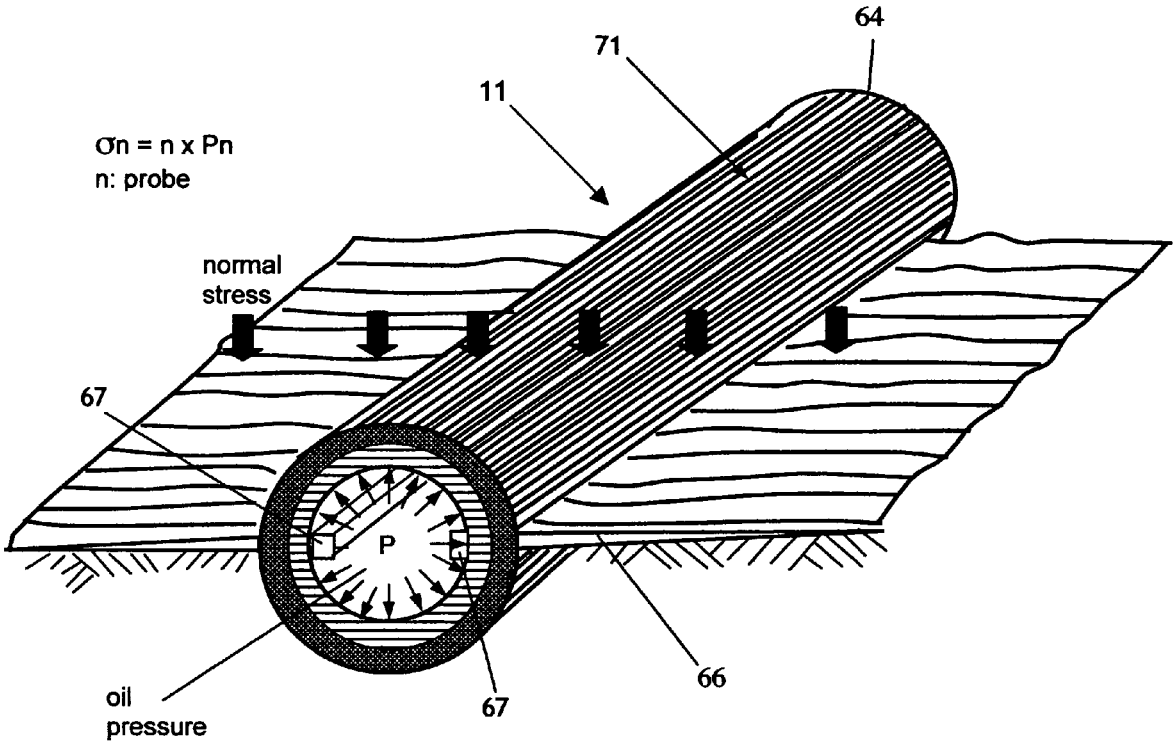
FIG. 7 is a schematic view of the borehole probe of the present invention, showing the force relationship and the single fracture plane.
Figure 9:
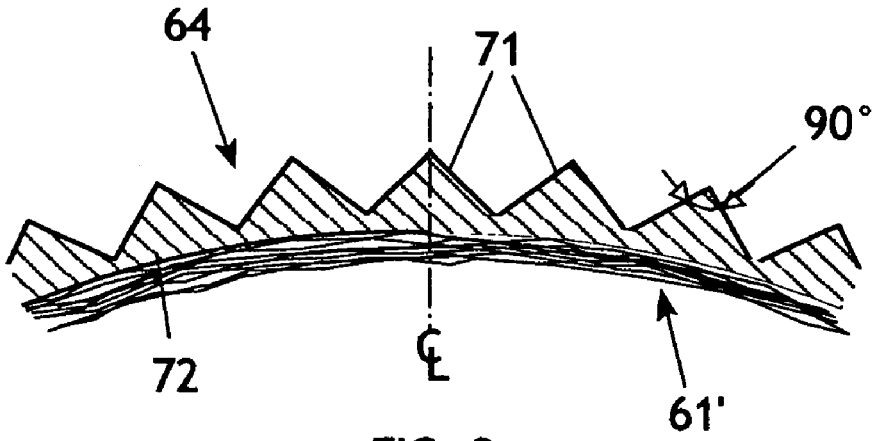
FIG. 9 is a magnified partial cross-sectional view of the friction teeth design of the flexible friction shell of the expandable loading tube of the invention used for general soft rock media.
Figure 10:
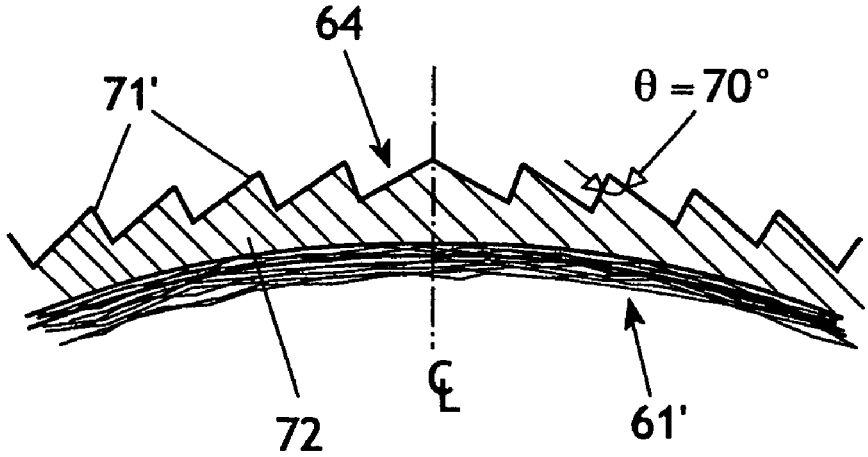
FIG. 10 is a magnified partial cross-sectional view of another embodiment of the flexible friction shell of the expandable probe of the invention, especially developed for extremely hard rock media such as granite.

A salient feature of the friction shells 64 is the provision of longitudinally extending ridges formed in the outer surface of the shells 64 and defining longitudinally extending teeth 71 shown in FIGS. 7, 9 and 10. The teeth 71 are essential to engage the borehole wall with a maximum friction effect, whereby the expansive force of the loading section of the probe is applied uniformly and maximally in a direction perpendicular to the datum plane 66. With regard to FIG. 9, each shell 64 includes a base layer 72 of super high-strength steel that is sufficiently thin to be flexible, and the teeth 71 that extend outwardly from the base layer 72. For soft rock underground media, an angle of 90° (included) between the longitudinally extending facets that define each vertex is found to be optimal for maximizing frictional engagement with the borehole wall, as well as durability. As shown in FIG. 10, for use with hard rock media the teeth 71' are defined by vertices having an included angle of approximately 70° to optimize friction and durability. In FIG. 10 the angles of the teeth are distributed symmetrically about the centerline CL normal to the datum plane 66, each ridge having one defining facet that extends generally radially outwardly from the shell and facing the centerline of the shell in axis-symmetric fashion. In both embodiments of the teeth, the vertices are sharpened to a knife edge, and a single tooth width is approximately 1% of the circumference of the loading tube, resulting in approximately 100 teeth protruding from both shells 64. The thin steel base is made flexible by defining a thickness dimension that is 1%-2% of the circumference of the loading tube. This combination of factors delivers a maximum saturation frictional engagement between the expanding probe and the borehole wall, assuring that the single-fracture opening in the borehole occurs at the datum plane 66.

In addition, a layer of Kevlar fibers 61' is attached to the steel teeth half shell circumferentially as shown in FIGS. 9 and 10. The fibers 61' provide strength to the urethane sleeve and prevent tensile failure of the thin flexible steel shell.

The method of the invention employs the apparatus described above to be inflated with hydraulic fluid and expand against a borehole wall, and to measure the expansion of the borehole boundary as a function of the hydraulic pressure. More particularly, the expanding probe, due to its construction and the fact that the hemi-cylindrical shells engage the borehole boundary and drive it outwardly in opposed fashion along the centerline direction CL, causes a single-fracture to be initiated at the datum plane 66 (FIG. 7). The expansion pressure is related to the diametrical expansion in accordance with a force-balance principal, which is newly realized in the present invention.

With regard to FIGS. 7 and 8, the force-balance principle is established based on the relationship found between the force vector ($\sigma_N$) acting normal to the single-fracture plane and the fracture reopening pressure ($p_N$); that is, $\sigma_N = n \cdot p_N$. This relation is illustrated by the typical single-fracture measurement data (p-d diagram) given in FIG. 8. The proportionality constant n is found to be a function of elastic stiffness (tan $\theta_E$) of the ground in the direction of the stress vector $\sigma_N$. With reference to the diagram of FIG. 8, the method begins with expansion of the probe, beginning at the origin of the graph when the probe contacts the boundary. The hydraulic inflation pressure may be in the range of 10,000-30,000 psi (approx. 69-210 megapascals). The borehole diameter increases fairly linearly with the pressure loading, the inflation pressure acting against the combined effects of tensile strength of the underground media and the vector component of the in-situ underground stress field that acts in the centerline direction; i.e., normal to the single-fracture plane. The angle of the initial p-d linear relationship is $\theta_D$. At a point F, a single-fracture is initiated as shown by the sudden increasing rate of diametrical expansion. Thereafter the probe expansion proceeds at a rate greater than before. The inflation pressure is then relieved, and probe is then allowed to retract. However, it does not return to the initial diameter, instead returning to the previous diameter plus ground consolidation $\Delta C$.

Immediately following this first loading cycle of the fracture initiation, the probe is inflated again by the second cycle loading, and the rising p-d line proceeds linearly at a sharper angle ($\theta_E$) to point N where the single-fracture begins to re-open at $p = p_N$. This is a significant point at which the pressure ($p_N$) exceeds the countervailing underground stress normal to the datum plane, and initiates the existing single-fracture to reopen with a direct force balance relationship between the ground stress vector component ($\sigma_N$) acting normal to the single-fracture plane and the probe loading pressure ($p_N$) at the moment of fracture reopening.

The relation is found to be specific to the elastic coefficient of the rock in the direction of the stress vector as follows.

$$\rho_N = n \cdot p_N \tag{1}$$

where:

$\sigma_N$=ground stress vector acting normal to the single-fracture.

$p_N$=probe loading pressure at the moment of fracture reopening.

n=proportionality constant, which is a function of elastic stiffness (tan $\theta_E$) of the ground in the $\sigma_N$ direction.

tan $\theta_E$=orientation sensitive elastic stiffness automatically obtained in the p-d diagram of the instrument (FIG. 8).

Note that the elastic modulus $E_E$, deformation modulus $E_D$, ground consolidation factor $\Delta C$, and tensile strength T, may also be derived from the p-d diagram of FIG. 8, either by tracking the p-d diagram onscreen through the built-in data processing software, by inspection or by simple calculation.

Figure 12:
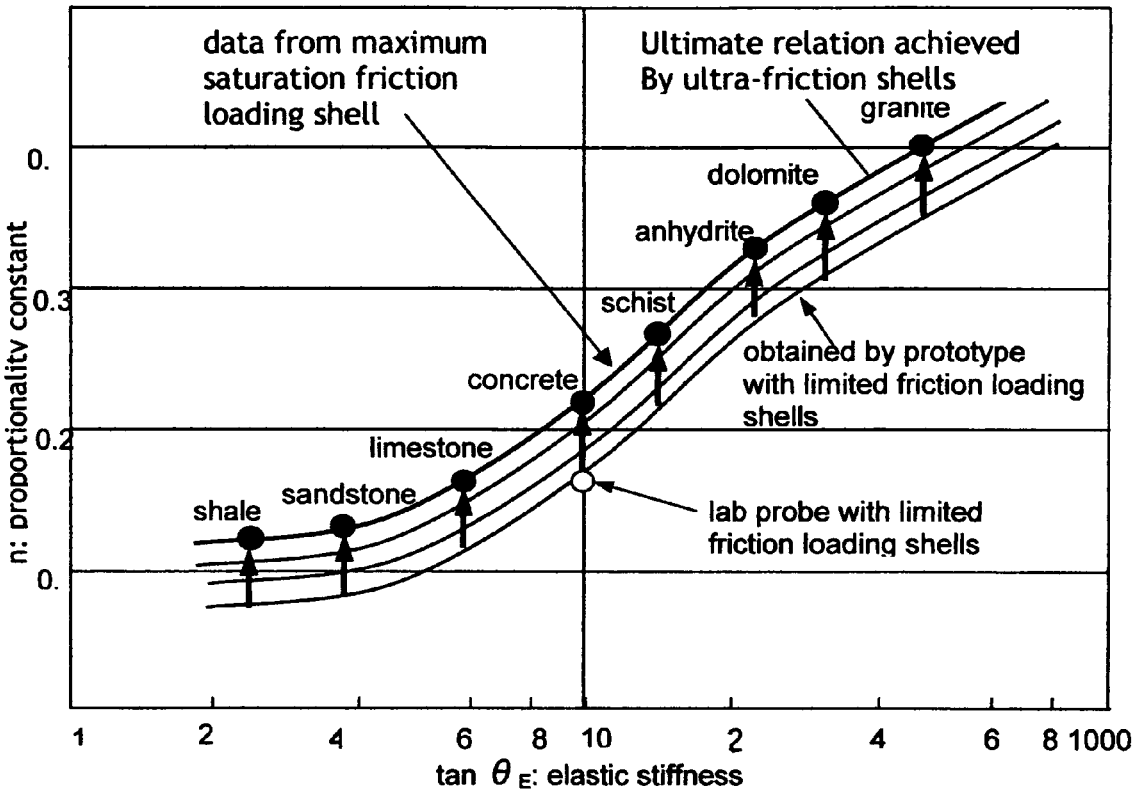
FIG. 12 is a graph depicting the proportionality constant n with respect to tan $\theta_E$ of the p-D diagram of FIG. 8.

The above relationship (Eq. 1) indicates the force balance principle that the normal stress $\sigma_N$ can be determined directly from the $p_N$ and tan $\theta_E$ of the p-d diagram, as n is a function of tan $\theta_E$. By utilizing the advanced probe with the maximum saturation friction shells, the n-function has been established to directly measure the stress vector $\sigma_N$ from the p-d diagram obtained by the probe. This direct measurement is due to three major development efforts; (1) laboratory verification of constant n-value for rock medium by utilizing cement blocks, (2) development of the advanced single-fracture probe with maximum saturated (ultimate) friction loading shells and (3) field data collection to establish the relationship of n to tan $\theta_E$ in general ground media. As a result, the n versus tan $\theta_E$ relationship has been established for the advanced Stressmeter in general earth media as shown in FIG. 12. It is this relationship that makes possible the determination of in-situ $\sigma_N$ directly from the p-d diagram immediately and automatically on site.

The function of the n-proportionality constant has been established experimentally in the laboratory by utilizing a borehole made in large test blocks, which are two dimensionally loaded to create a controlled stress state of $\sigma_{max}$, $\sigma_{min}$ and $\phi$. Under various stress states created in the block, single-fracture reopening experiments were carried out to evaluate the n-function for standard cement. The test results obtained under a large number (22) of different loading conditions have demonstrated a consistency of n-value for the given test material totally independent of stress state. Since it is difficult to create a large number of test blocks of natural rocks in the laboratory, overburden weights in natural underground openings were utilized as applied stresses for the natural ground tests of n. It is this natural ground data that enabled us to establish the natural function of n vs. tan $\theta_E$ as shown in FIG. 12. This figure also illustrates that the n-value derived from empirical data increased as the probe instrument of the invention was improved to generate greater boundary friction of the loading tube with the borehole wall. Thus, the invention is built with the maximum saturated (ultimate) friction shell to secure the ultimate measurement of the stiffness (tan $\theta_E$) of the ground for automatic calculation of ON-vector value as well as stress field condition from a set of the $\theta_N$ values.

In addition, it is clear that the data of FIG. 12 reflect an intuitive understanding of the nature of rock media: the elastic stiffness of the material increases as the rock hardness increases from soft rock such as shale and sandstone up to hard granite. This is further confirmation of the validity of the data and the methodology of the invention.

The n-value described above is device-specific, and may be established for a device design as follows. With regard to FIG. 13, the probe apparatus 11 described above may be placed in a borehole, such as the test hole 81. The electronics section 14 of the probe includes a pressure sensor that monitors the pressure of the hydraulic fluid delivered to the loading section 12 of the probe, as well as the data feed from the LVDT sensors that detect the diametrical dimension of the loading section. A PC circuit board includes signal conditioners that receive the signals from the pressure sensor and LVDTs, and feed them to a 14 bit ADC. The digitized data is then transmitted to a microprocessor, which also receives data from an orientation sensor that detects the angular disposition of the datum plane with respect to the axis of the hole. The output of the microprocessor is fed to a data transmission driver, and thence through a signal line to a control box above ground, and thence to a computer that is programmed to analyze the data. A power supply is connected to the control box to send power down the signal line to drive the electronic devices of the downhole apparatus. Likewise, an hydraulic hose or pipe may extend from outside the upper end of the hole to the probe 11 in the borehole to supply the hydraulic fluid under very high pressure. The computer program may be written to operate the probe automatically and repeatedly (when necessary) to take data at prescribed times or time intervals. It is significant to note that the overburden of the horizontal test hole 81 creates a stress ON that is related to the depth at which the hole 81 is located. By knowing the value for ON, is it possible to solve equation (1) above for n, and this value for n will remain constant for this device design, no matter where or in what media it is employed.

Figure 11:
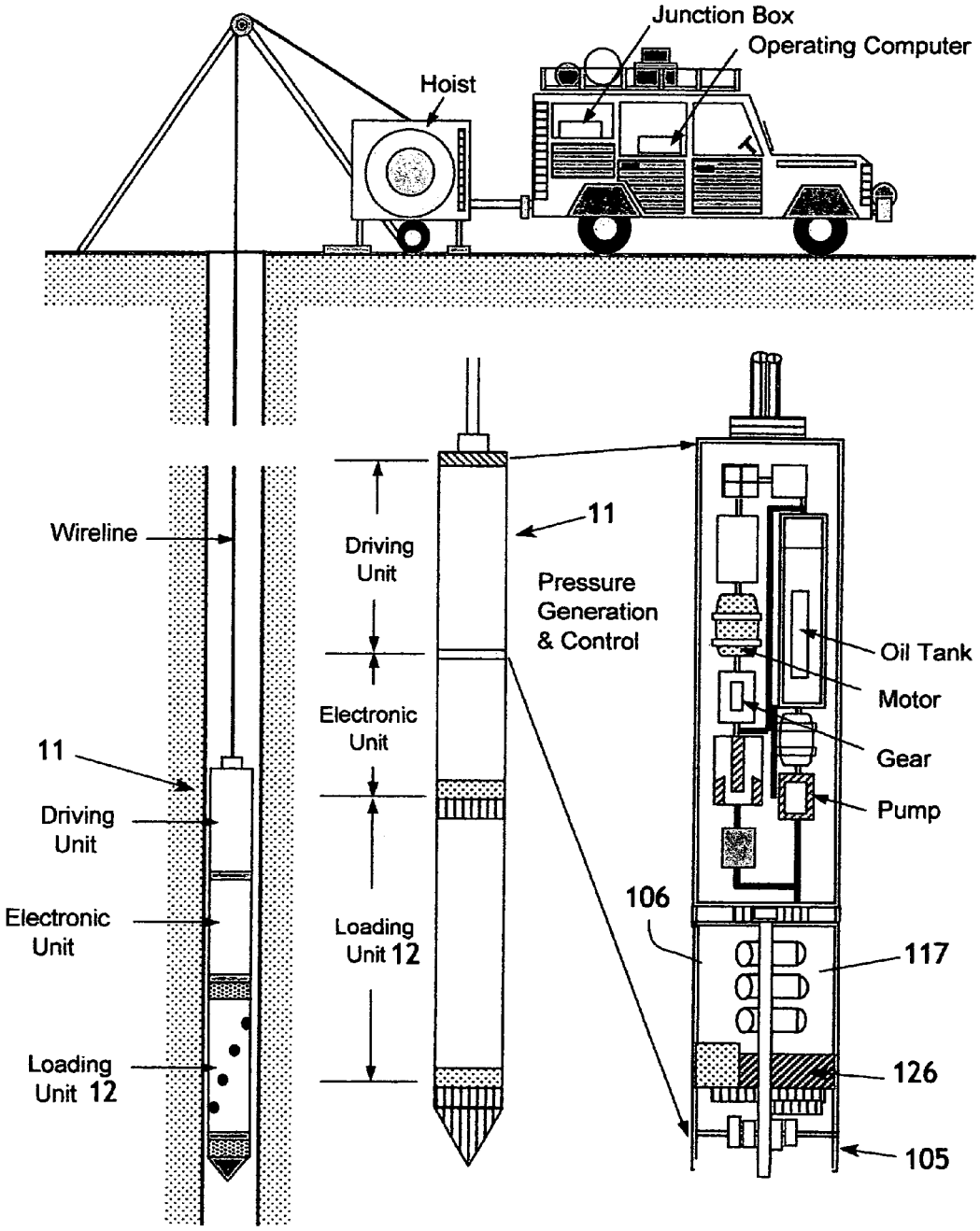
FIG. 11 is a schematic elevation of a wireline embodiment of the invention deployed in a borehole.

With regard to FIG. 11, the flexibility and ease of use of the apparatus of the invention and the direct data readout of the advanced single-fracture method opens up new possibilities of high-efficiency in-situ stress measurement to be made at great depth needed for the oil and gas industry, earthquake stress measurement and other deep underground work.

Figure 13:
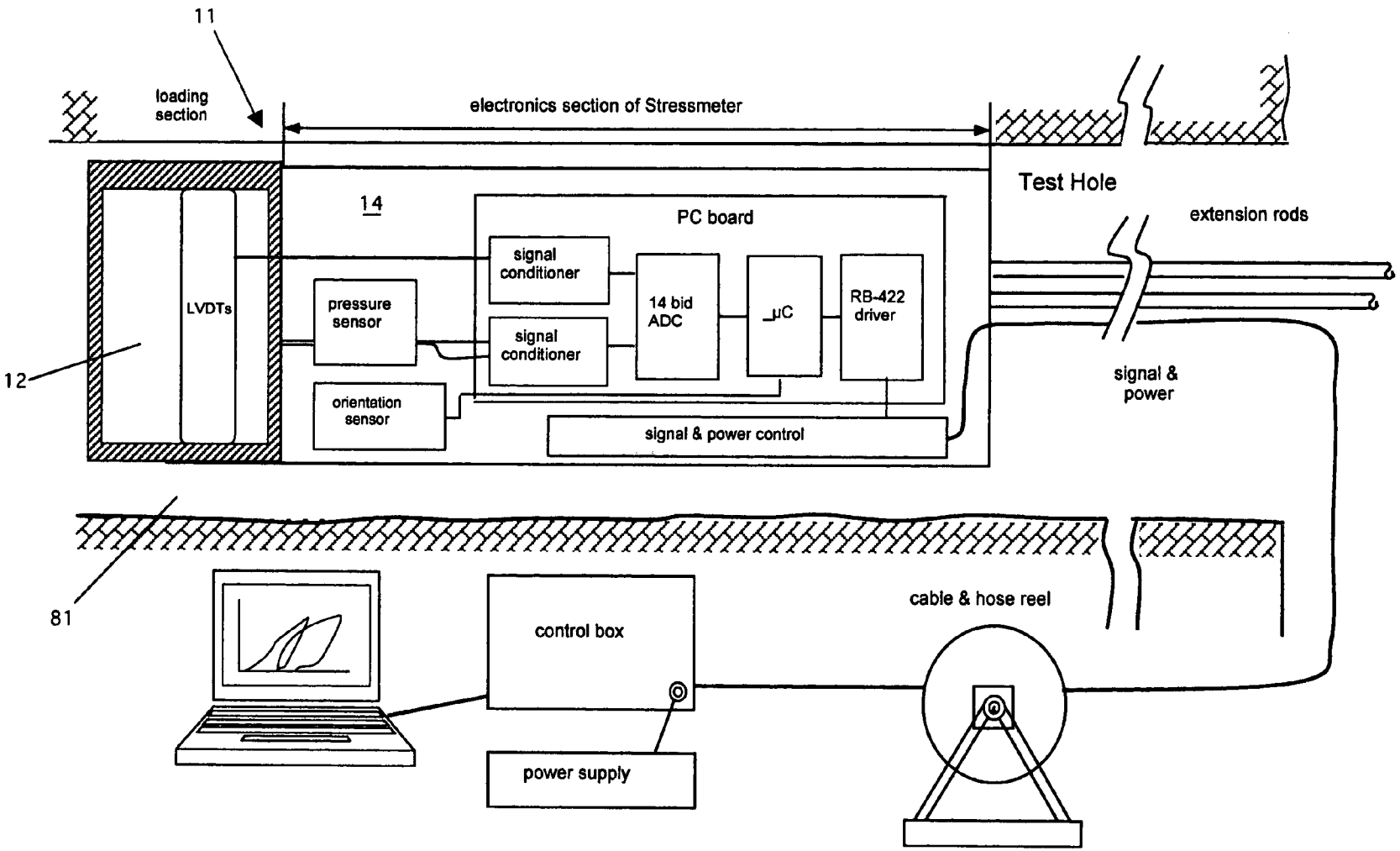
FIG. 13 is a schematic view of the apparatus of the invention deployed for manual operation by using extension rods.

The probe assembly of the invention may be suspended by a wireline cable that provides electrical power, data communication and the necessary tensile strength as shown in FIG. 11. The downhole probe includes a driving unit that has an electrical pump supplied with an oil tank to operate the loading section of the probe. It also includes an electrical motor and gear drive to rotate the electronic and loading sections of the probe to any selected angle around the borehole axis by use of the built-in orientation gear system shown. Thus multiple single fracture planes may be created and tested quickly in sequence. Three directional measurements at 60° angular separations may be utilized for standard applications and four directional measurements at 45° angular separations are utilized for high-accuracy applications. Note that the wireline is operated by a vehicle equipped for the operation as illustrated in the figure. The computer software made to operate the probe automatically utilizes the digital PC board to process the data in the probe, as shown in FIG. 13. This portable deep well Stressmeter may be set up in an existing borehole, used to make quick and accurate underground stress measurements, and then removed and driven to another location to carry out stress measurements in another borehole. In this way a single mobile stressmeter constructed in accordance with this invention may be used to monitor a plurality of boreholes over a wide area, providing a broad picture of the underground stress field throughout that area.

The original single-fracture method was considered not applicable in badly fracture complex ground. This natural limitation of the prior art method has been overcome by the present invention, which introduces pre-grouting of the test hole to make the borehole boundary sufficiently uniform for creation of accurate single-fractures. This pre-grouting step not only expands the application of the invention to an extremely wide range of natural ground but also provides long-term protection of the test hole for repeating stress measurement at a same position in the same borehole as a function of time as many times as needed.

The grout application pressure is restricted to the gravity level of the location in the borehole to prevent introducing any high artificial pressure into the natural stress condition of the ground which is to be measured. This pre-grouting method is important for the stress measurement especially in shallower depths where the natural condition of the ground tends to be complex and deviates far from the ideally elastic condition for which the original method was developed.

The technology for applying grout in a borehole is well-known in the drilling arts, having been used for many years to stabilize production wells and the like. However, the use of grout to establish a uniform condition of a borehole boundary for purposes of undertaking stress measurements through borehole expansion is not known in the prior art.

Figure 14:
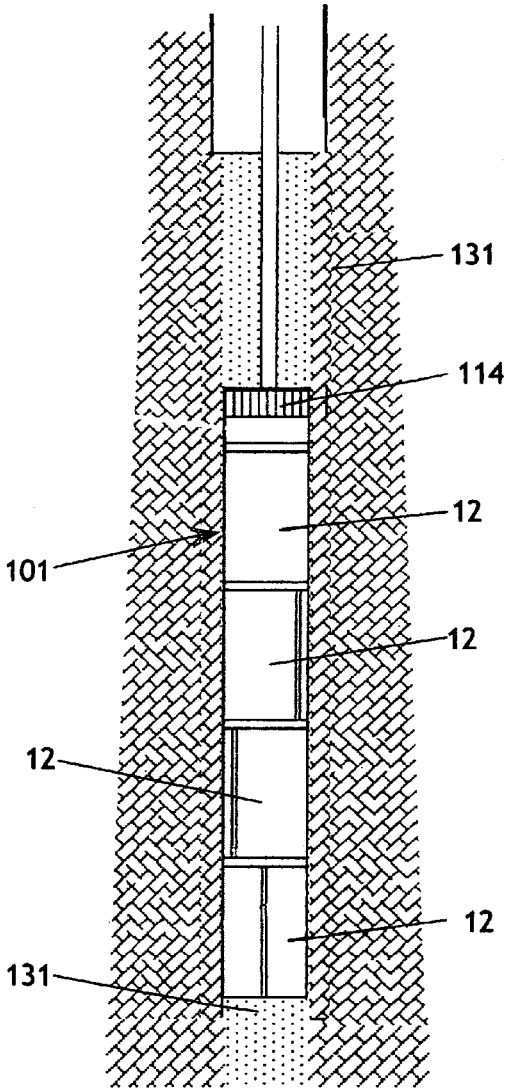
FIG. 14 is a side view of a further embodiment of the instrument of the invention utilized as a permanent burial probe.

A further embodiment of the invention is designed for use as a long-term installation in a borehole to measure and monitor magnitude dynamics of the earthquake stress for accurate time-prediction of forthcoming major earthquakes. The original idea was described in U.S. Pat. No. 5,675,088, issued Oct. 7, 1997. To provide a new earthquake prediction probe, a permanent burial method is developed as shown in FIG. 14. The burial probe 101 is made of a set of 3 to 4 single-fracture loading sections mounted with equal angular interval of 60° or 45°. Advantages of this probe are low cost and high reliability for earthquake stress monitoring and accuracy of time-prediction. Because the probe is cemented permanently in the borehole 131, it functions accurately and economically for future earthquake time-prediction.

Figure 15:
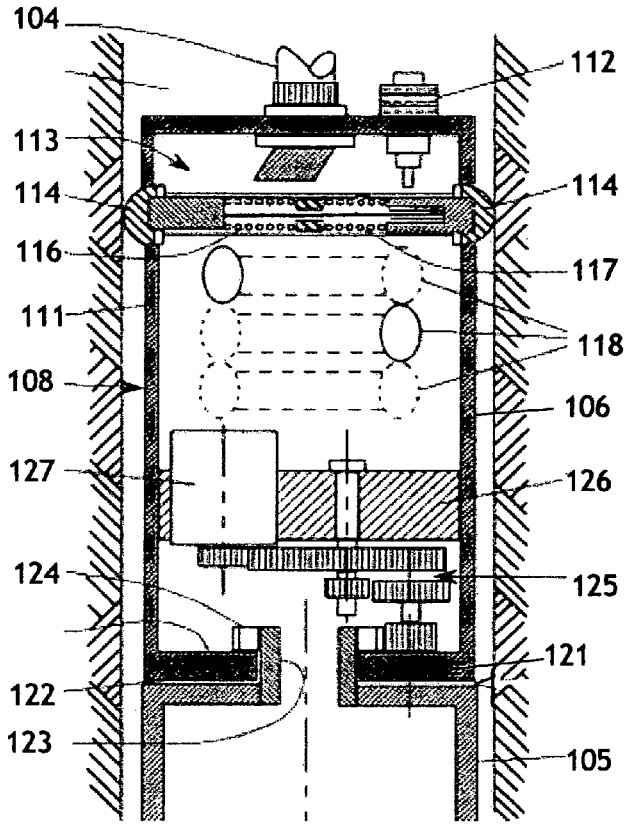
FIG. 15 is a cross-sectional elevation of the rotational mechanism of a further embodiment of the invention, which operates as a non-burial probe for portable operation.

In contrast to the permanently sealed method, the invention may provide a removable method and assembly 108 as shown in FIG. 15. This is a mobile system with one directional loading section 11 (FIG. 11) (not shown, but described previously) with a probe rotation system. It is connected to a cable 104 and to an hydraulic pressure line 112. An anchor-caliper assembly 113 is secured in the housing 111, including opposed, diametrically extendable heads 114 adapted to impinge on the borehole wall. The heads 114 are resiliently biased outwardly by a pair of springs 116 to impinge on the borehole wall. An LVDT 117 is secured between the heads to provide highly accurate measurements of the borehole diameter and to warn of borehole collapse or failure. The stressmeter probe consisting of electronic and loading sections, as described previously, depend immediately beneath this rotation system.

The lower end of the housing 111 includes an end wall 121 having a central opening 122 therein. The upper end of the electronics section 105 (also employed in the embodiment of FIG. 11) includes an upwardly extending neck 123 received through the opening 122 in freely rotating fashion. A drive gear 124 is secured about the neck 123 within the anchor unit 106 to secure the units 105 and 106 together. An electric motor 127 is supported on a strut 126 in the anchor unit 111, and is connected through a gear reduction assembly 125 to the drive gear 124. The motor is actuated selectively to rotate the electronics section 105 and the loading section 12 which extends below the electronic section 105.

The loading section 12 may be operated serially and reiteratively to measure the underground stress vector acting normal to the datum plane of the loading unit, and the loading unit may be rotated to selected orientations to collect data. A complete picture of the underground stress field condition may be obtained from a set of stress vectors determined at least in three different vector orientations.

The embodiments of FIGS. 14 and 15 may also find utility in carrying out the method for automatic monitoring of earthquake shear stresses and quantitative forecast of shallow earthquakes. The prior patent describes the fundamental processes occurring in a shallow earthquake, which is typically the most destructive to human life and property. It identified a depth window of observation in which the maximum and minimum principal lateral stress vectors may be measured, the window being in the range of 500-1000 meters deep. The prior patent referenced above emphasizes the fact there are changes in the underground stress field within the observation window that may be detected and used to predict an imminent earthquake.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A method for determining the stress state and material properties in underground media surrounding a borehole, comprising the steps of:

first, placing an expandable probe having a single-fracture probe orientation into said borehole at a specific depth of measurement;

second, setting the single-fracture orientation of the probe normal to a stress vector to be measured;

third, expanding said probe with increasing fluid loading pressure to initiate a single-fracture plane, while simultaneously measuring the diametrical expansion of the probe and the fluid loading pressure;

fourth, reducing the fluid loading pressure to zero, then reapplying the loading pressure to reopen the single-fracture plane;

fifth, obtaining the pressure versus diametrical expansion (p-d) diagram from the third and fourth steps;

sixth, calculating material properties from the p-d diagram by tracking on the diagram;

seventh, calculating the stress conditions from the p-d diagrams;

further including the step of providing a pair of high friction hemi-cylindrical shells secured to the outer surface of the expandable probe to create a maximum saturated friction effect on the borehole boundary for accurate measurement of individual stress vectors, each shell comprising a unitary component of high strength material, said shells having confronting longitudinal edges that extend generally in a datum plane that corresponds to said single-fracture orientation.

2. The method of claim 1, further including the step of providing a plurality of longitudinally extending ridges on the outer surfaces of said pair of shells, said ridges defining sharp, tooth-like vertices that are adapted to impinge on the borehole wall in a high friction engagement to exert the maximum saturated friction.

3. The method of claim 2, wherein said ridges are each provided with an included angle of approximately 90° for high durability in application to general rock media.

4. The method of claim 2, wherein said ridges are each provided with an included angle of approximately 70°, with an axis-symmetric teeth configuration, each ridge having a generally radially extending facet facing the center-line of the shell to maximize the friction in hard rocks.

5. The method of claim 1, further including the step of forming said shells of super-strength steel sufficiently thin to be flexible to conform to the borehole boundary, and further including a layer of super strength fibers secured to the inner surface of each shell to reinforce and protect each shell from tension failure.

6. A method for determining the stress state and material properties in underground media surrounding a borehole, comprising the steps of:

first, placing an expandable probe having a single-fracture probe orientation into said borehole at a specific depth of measurement;

second, setting the single-fracture orientation of the probe normal to a stress vector to be measured;

third, expanding said probe with increasing fluid loading pressure to initiate a single-fracture plane, while simultaneously measuring the diametrical expansion of the probe and the fluid loading pressure;

fourth, reducing the fluid loading pressure to zero, then reapplying the loading pressure to reopen the single-fracture plane;

fifth, obtaining the pressure versus diametrical expansion (p-d) diagram from the third and fourth steps;

sixth, calculating material properties from the p-d diagram by tracking on the diagram;

seventh, calculating the stress conditions from the p-d diagrams, wherein said seventh step yields stress vector $\sigma_N$ acting normal to the single-fracture plane according to the equation:

$$\sigma_N = n \cdot p_N$$

where $\sigma_N$=vector component of the ground stress acting normal to the single-fracture to be measured;

$p_N$=probe loading pressure at the moment of fracture reopening;

$n=f(\tan \theta_E)$ is the experimental function established specific to n vs. $\tan \theta_E$ relationship, and, $\tan \theta_E$=the elastic stiffness of the ground automatically obtained in the p-d diagram.

7. The method of claim 6, wherein said sixth step obtains the following material properties: 1) elastic modulus, 2) deformation modulus, 3) ground consolidation factor, 4) tensile strength, 5) elastic stiffness and 6) proportionality constant (n).

8. The method of claim 6, further including the step of rotating said probe to at least three different angular orientations about said axis of said borehole to determine the stress tensor field surrounding the borehole, said stress tensor field being automatically calculated through the software of the system to provide maximum stress vector, minimum stress vector, and their orientations.

9. An apparatus for measuring stress state and material properties in underground media surrounding a borehole, including:

a tubular expandable loading section having a longitudinal axis that is generally coextensive with the axis of the borehole;

a pair of high friction hemi-cylindrical shells secured to the outer surface of said loading section, each shell comprising a unitary component of high strength material, said shells having confronting longitudinal edges that extend in parallel and define a datum plane from which a single-fracture plane is initiated and reopened to carry out a force-balance measurement.

10. The apparatus of claim 9, wherein said shells are fabricated of super-strength steel being sufficiently thin to be flexible about the boundary of said borehole.

11. The apparatus of claim 9, wherein said shells include a plurality of longitudinally extending ridges on the outer surfaces of said pair of shells, said ridges defining sharp, tooth-like vertices that are adapted to impinge on the borehole wall in a high friction engagement.

12. The apparatus of claim 11, wherein said ridges are each provided by super strength steel with an included angle of approximately 90° for high durability in application to general rock media.

13. The apparatus of claim 11, wherein said ridges are each provided with an included angle of approximately 70° with each ridge including a facet extending radially outwardly and facing the center line of the respective shell to create maximum saturated friction in hard rocks.

14. The apparatus of claim 9, wherein said loading section includes a central mandrel extending along said longitudinal axis, a tubular elastic loading tube disposed concentrically about said mandrel, and a pair of end cap assemblies secured to opposed ends of said mandrel to engage and seal the opposed ends of said loading tube.

15. The apparatus of claim 14, wherein said end cap assemblies include a pair of end caps secured to the mandrel in axially spaced relationship;

a pair of elastomeric assemblies, each elastomeric assembly comprising a sleeve-like structure secured about a respective end of the loading tube;

each of said end caps including a cup-like recess opening toward the opposed end cap;

each elastomeric assembly including a first annular portion received within an annular spaced defined by said cup-like recess and the mandrel.

16. The apparatus of claim 9, further including means for rotating said probe about said axis of said borehole, whereby measurements of stress state and material properties may be made at selected angles about said borehole.

17. The apparatus of claim 9, further including means for measuring diametrical expansion between said shells perpendicular to said datum plane.

18. The apparatus of claim 17, further including wireline means for suspending said loading section in said borehole and supplying said loading section with high pressure fluid to expand said loading section, and for transmitting data from said means for measuring to a recording means.

19. The apparatus of claim 17, further including an electronics housing secured to said loading section to receive data from said means for measuring diametrical expansion, and for measuring the inflation pressure of said expandable loading section.

20. The apparatus of claim 9, further including a plurality of said loading sections disposed in axially adjacent alignment in said borehole, each having a respective datum plane angularly offset from the others.

21. An apparatus for measuring stress state and material properties in underground media surrounding a borehole, including:

a tubular expandable loading section having a longitudinal axis that is generally coextensive with the axis of the borehole;

a pair of high friction hemi-cylindrical shells secured to the outer surface of said loading section, said shells having confronting longitudinal edges that extend in parallel and define a datum plane from which a single-fracture plane is initiated and reopened to carry out a force-balance measurement;

said loading section including a central mandrel extending along said longitudinal axis, a tubular elastic loading tube disposed concentrically about said mandrel, and a pair of end cap assemblies secured to opposed ends of said mandrel to engage and seal the opposed ends of said loading tube;

wherein said end cap assemblies include a pair of end caps secured to the mandrel in axially spaced relationship;

a pair of elastomeric assemblies, each elastomeric assembly comprising a sleeve-like structure secured about a respective end of the loading tube;

each of said end caps including a cup-like recess opening toward the opposed end cap;

each elastomeric assembly including a first annular portion received within an annular spaced defined by said cup-like recess and the mandrel;

said cup-like recess including an annular rim, and further including a plurality of linking rods embedded in said elastomeric assembly, said linking rods arrayed in parallel, closely packed fashion within the periphery of the assembly, said linking rods including like first ends disposed within said annular rim and restrained thereby from radial outward movement.

22. An apparatus for measuring stress state and material properties in underground media surrounding a borehole, including:

a tubular expandable loading section having a longitudinal axis that is generally coextensive with the axis of the borehole;

said loading section including a central mandrel extending along said longitudinal axis, a tubular elastic loading tube disposed concentrically about said mandrel, and at least one end cap assembly secured to an end of said mandrel to engage and seal the adjacent end of said loading tube;

said end cap assembly include an end cap secured to said end of the mandrel;

at least one elastomeric assembly, comprising a sleeve-like structure secured about said adjacent end of said loading tube;

said end cap including a cup-like recess opening toward the opposed end cap;

said elastomeric assembly including a first annular portion received within an annular spaced defined by said cup-like recess and the mandrel;

said cup-like recess including an annular rim, and further including a plurality of linking rods embedded in said elastomeric assembly, said linking rods arrayed in parallel, closely packed fashion within the periphery of the assembly, said linking rods including like first ends disposed within said annular rim and restrained thereby from radial outward movement.

23. The apparatus of claim 22, further including first hinge means for permitting outward rotation of each of said linking rods about said annular rim.

24. The apparatus of claim 23, further including a plurality of anchor rods embedded in said elastomeric assembly, said anchor rods arrayed in parallel, closely packed fashion within the periphery of the assembly;

each of said anchor rods being paired with a respective one of said linking rods; and, means for operatively engaging said paired anchor rods and said linking rods.

25. The apparatus of claim 24, wherein said means for operatively engaging includes second hinge means for joining each of said anchor rods with a respective one of said linking rods in a hinged pair relationship, said second hinge means including pivot means joining like second ends of said linking rods with respective first ends of said anchor rods in limited pivoting motion.

26. The apparatus of claim 25, wherein each of said anchor rods further includes an arcuate channel extending chordally through a medial portion of said rod body.

27. The apparatus of claim 26, wherein said arcuate channels of said plurality of anchor rods are aligned in annular fashion to define an annular groove in said elastomeric assembly, and further including an annular band of elastomer disposed in said arcuate channels and arranged to exert a strong spring return force radially inwardly on said plurality of anchor rods.

28. The apparatus of claim 27, further including inner seal means, comprising a cylindrical structure of layers of high-strength fibers arranged in a diagonal helical orientation to form a fiber bridge spanning the gap between adjacent linking rods and anchor rods to form a high-pressure seal.

* * * * *